US010219072B1

(12) United States Patent
Sullivan, Jr.

(10) Patent No.: US 10,219,072 B1
(45) Date of Patent: Feb. 26, 2019

(54) DUAL MICROPHONE NEAR FIELD VOICE ENHANCEMENT

(71) Applicant: Panasonic Automotive Systems Company of America, Division of Panasonic Corporation of North America, Peachtree City, GA (US)

(72) Inventor: Christopher Lee Sullivan, Jr., Farmington Hills, MI (US)

(73) Assignee: Panasonic Automotive Systems Company of America, Division of Panasonic Corporation of North America, Peachtree City, GA (US)

( * ) Notice: Subject to any disclaimer, the term of this patent is extended or adjusted under 35 U.S.C. 154(b) by 0 days.

(21) Appl. No.: 16/047,354

(22) Filed: Jul. 27, 2018

Related U.S. Application Data

(60) Provisional application No. 62/550,448, filed on Aug. 25, 2017.

(51) Int. Cl.
*H04R 3/00* (2006.01)
*H04R 1/40* (2006.01)
*H04R 1/02* (2006.01)

(52) U.S. Cl.
CPC ..... *H04R 3/005* (2013.01); *H04R 1/028* (2013.01); *H04R 1/406* (2013.01); *H04R 2201/401* (2013.01); *H04R 2499/13* (2013.01)

(58) Field of Classification Search
None
See application file for complete search history.

(56) References Cited

U.S. PATENT DOCUMENTS 7,146,013 B1 * 12/2006 Saito ..... H04R 3/005 381/92
2006/0153360 A1 * 7/2006 Kellermann ..... H04M 9/082 379/406.08
2007/0127736 A1 * 6/2007 Christoph ..... H04R 1/406 381/92
2008/0175407 A1 * 7/2008 Zhang ..... H04R 3/005 381/92
2011/0313763 A1 * 12/2011 Amada ..... H04R 3/005 704/233
2012/0330652 A1 * 12/2012 Turnbull ..... G10L 21/02 704/226

(Continued)

*Primary Examiner* — Paul Huber
(74) *Attorney, Agent, or Firm* — Laurence S. Roach, Esq.

(57) ABSTRACT

A dual microphone near field voice enhancement arrangement in a motor vehicle includes a seat having a headrest with two opposite lateral sides. Each of two microphones is mounted on a respective one of the two opposite lateral sides of the headrest. Each microphone produces a respective microphone signal indicative of sounds within a passenger compartment. An electronic processor receives the microphone signals. The processor calculates a time delay between the microphone signals, and uses the calculated time delay to estimate amplitudes of the microphone signals. The processor applies a respective time delay to each of the microphone signals based on the calculated time delay to produce two time-aligned signals. The processor applies a respective gain to each of the time-aligned microphone signals based on the estimated amplitudes to produce two time-aligned and gain corrected signals. The processor sums the time-aligned and gain corrected signals.

14 Claims, 3 Drawing Sheets

(56) References Cited

U.S. PATENT DOCUMENTS

| | | | | |
|---|---|---|---|---|
| 2013/0179163 | A1* | 7/2013 | Herbig | H04R 27/00<br>704/233 |
| 2016/0027428 | A1* | 1/2016 | Gul | H04R 27/00<br>381/71.4 |
| 2016/0100250 | A1* | 4/2016 | Baskin | H04R 1/02<br>297/217.4 |
| 2017/0150256 | A1* | 5/2017 | Christoph | H04R 3/005 |

* cited by examiner

DUAL MICROPHONE NEAR FIELD VOICE ENHANCEMENT

CROSS-REFERENCE TO RELATED APPLICATION

This application claims benefit of U.S. Provisional Application No. 62/550,448 filed on Aug. 25, 2017, which the disclosure of which is hereby incorporated by reference in its entirety for all purposes.

FIELD OF THE INVENTION

The disclosure relates to a communication system in a motor vehicle.

BACKGROUND OF THE INVENTION

Speech signals within a motor vehicle are typically recorded with a single microphone or microphone array in a fixed position within the car. If the microphone is placed as close as possible to the talker, the signal-to-noise ratio is increased, but the signal varies in loudness and timbre as the talker moves. If the microphone is placed farther away from the talker, loudness and timbre variations are reduced, but the background noise is harder to strip away from the speech signal.

SUMMARY

The present invention may add a second, strategically placed microphone close to the talker, and thus an even-sounding speech signal with a high signal-to-noise ratio is achieved.

In one embodiment, the invention comprises a dual microphone near field voice enhancement arrangement in a motor vehicle including a seat having a headrest. The headrest has two opposite lateral sides. Each of two microphones is mounted on a respective one of the two opposite lateral sides of the headrest. Each microphone produces a respective microphone signal indicative of sounds within a passenger compartment of the motor vehicle. An electronic processor is communicatively coupled to the microphones and receives the microphone signals. The processor calculates a time delay between the microphone signals, and uses the calculated time delay to estimate amplitudes of the microphone signals. The processor applies a respective delay to each of the microphone signals based on the calculated time delay to produce two time-aligned signals. The processor then applies a respective gain to each of the time-aligned microphone signals based on the estimated amplitudes to produce two time-aligned and gain corrected signals. The processor sums the time-aligned and gain corrected signals.

In another embodiment, the invention comprises a dual microphone near field voice enhancement method for a motor vehicle including a seat having a headrest in the motor vehicle. The headrest has two opposite lateral sides. Each of two microphones is mounted on a respective one of two opposite lateral sides of the headrest. A respective microphone signal is transmitted from each of the microphones. The microphone signals are indicative of sounds within a passenger compartment of the motor vehicle. A time delay between the microphone signals is calculated. The calculated time delay is used to estimate amplitudes of the microphone signals. A respective time delay is applied to each of the microphone signals based on the calculated time delay to produce two time-aligned signals. A respective gain is then applied to each of the time-aligned microphone signals based on the estimated amplitudes to produce two time-aligned and gain corrected signals. The time-aligned and gain corrected signals are summed together.

In yet another embodiment, the invention comprises a dual microphone near field voice enhancement arrangement in a motor vehicle. The arrangement includes two microphones. A first microphone being mounted to the left of a human driver of the motor vehicle, and a second microphone being mounted to the right of the human driver. Each microphone produces a respective microphone signal indicative of sounds within a passenger compartment of the motor vehicle. An electronic processor is communicatively coupled to the microphones and receives the microphone signals. The electronic processor calculates a time delay between the microphone signals. The electronic processor uses the calculated time delay to estimate amplitudes of the microphone signals. The electronic processor applies a respective time delay to each of the microphone signals based on the calculated time delays to produce two time-aligned signals. The electronic processor then applies a respective gain to each of the time-aligned microphone signals based on the estimated amplitudes to produce two time-aligned and gain corrected signals. The electronic processor sums the time-aligned and gain corrected signals. A loudspeaker is communicatively coupled to the electronic processor and emits audible sounds based on the sum of the gain corrected signals.

An advantage of the present invention is that it increases the often poor quality of hands free telephone and in-car-communication speech signals.

BRIEF DESCRIPTION OF THE DRAWINGS

A better understanding of the present invention will be had upon reference to the following description in conjunction with the accompanying drawings.

DETAILED DESCRIPTION OF THE PREFERRED EMBODIMENTS

Figure 1:
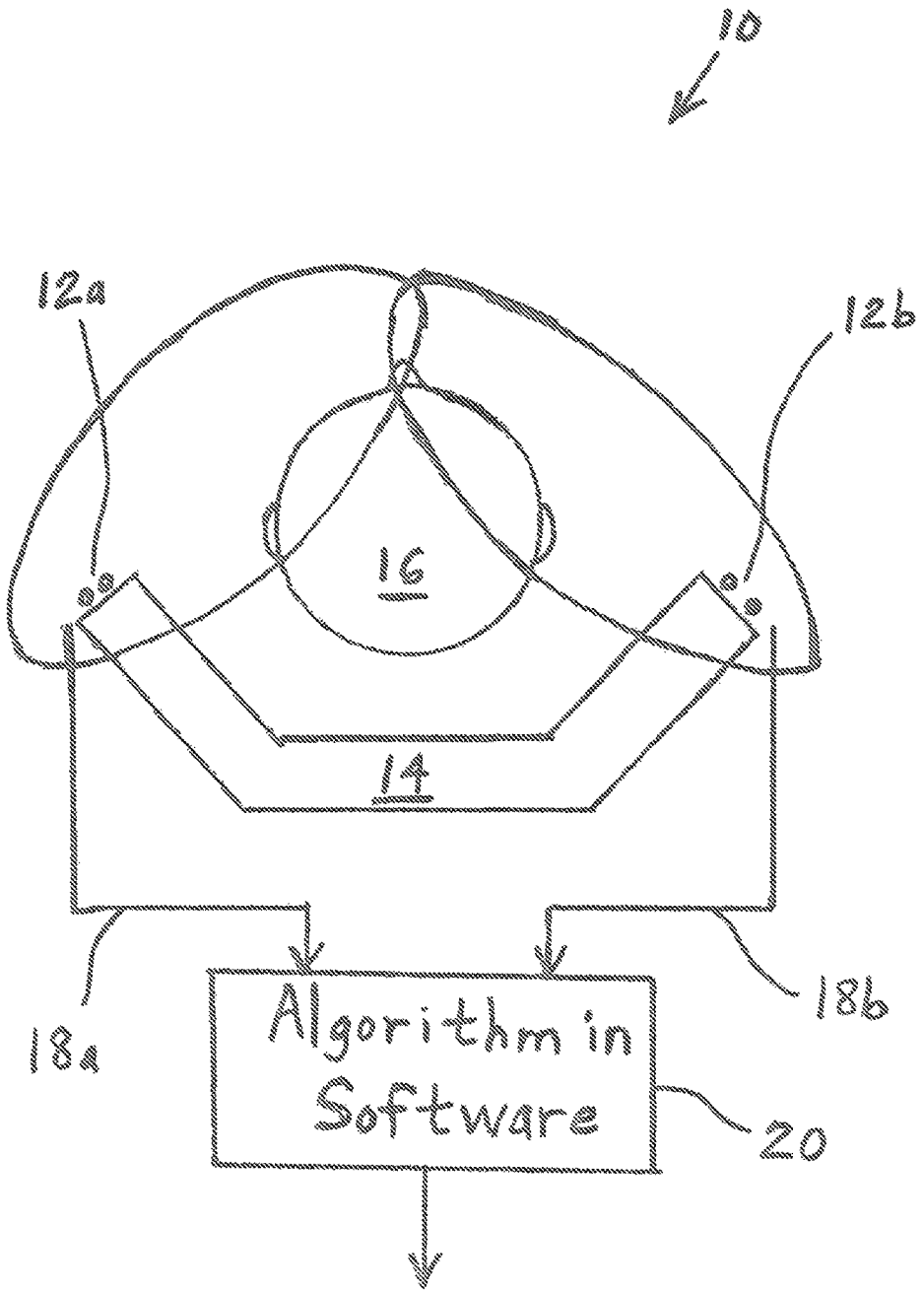
FIG. 1 is a diagram of one example embodiment of a dual microphone near field voice enhancement arrangement of the present invention for a motor vehicle.

FIG. 1 illustrates one example embodiment of a dual microphone near field voice enhancement arrangement 10 of the present invention for a motor vehicle. Arrangement 10 includes two microphones, or arrays of microphones, 12*a-b* arranged into first order endfire beamformers, mounted on either side of an extended headrest 14 in a vehicle. This extended headrest 14 may also contain loudspeakers (not shown) for personal audio, so a conventional headrest may accommodate the inventive microphone arrangement 10.

Figure 2:
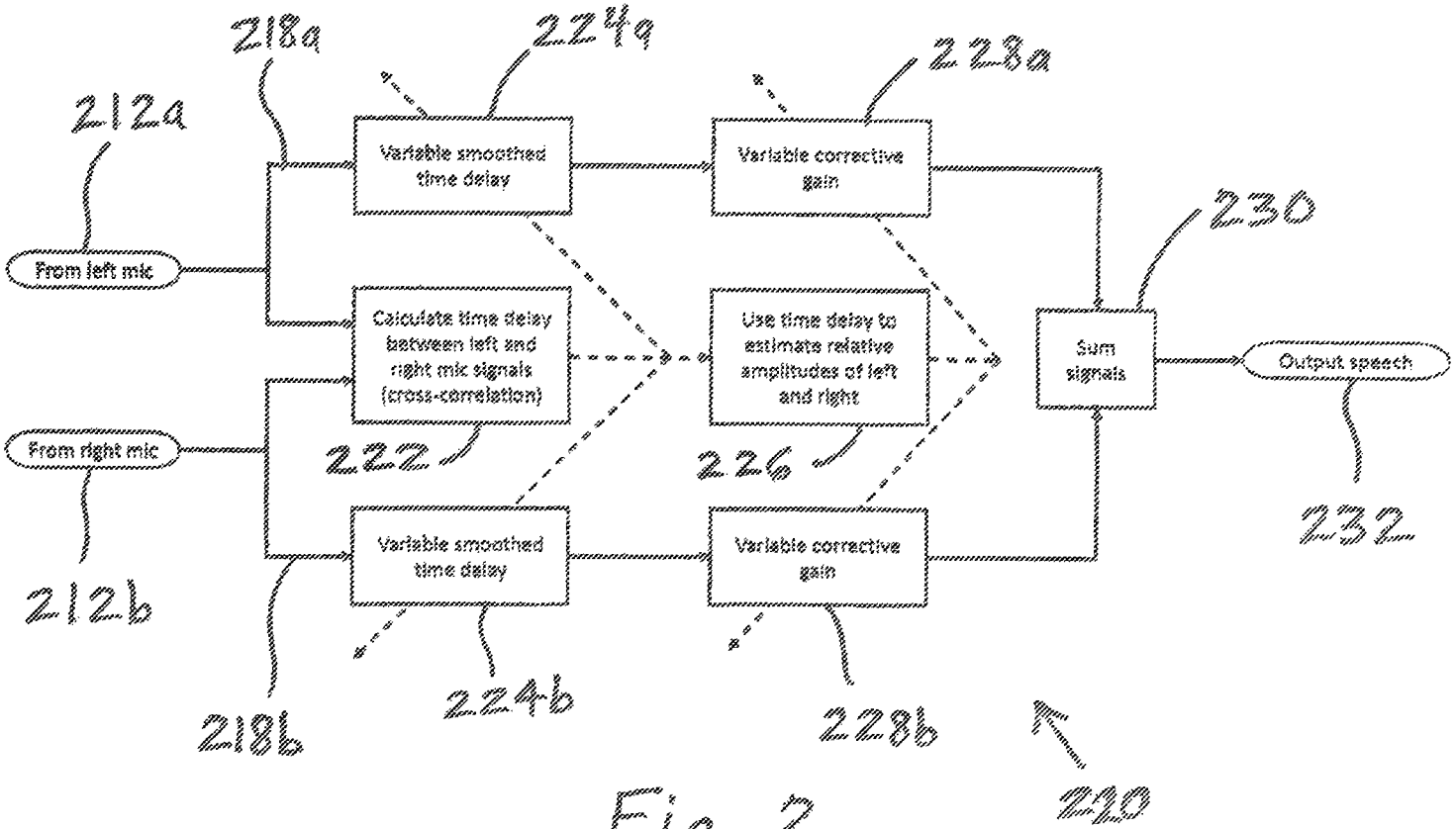
FIG. 2 is a flow chart of one example embodiment of a dual microphone near field voice enhancement method of the present invention for a motor vehicle.

Both microphone arrays 12*a-b* may be pointed towards the head 16 of the driver, passenger, or other human talker sitting in the seat that includes headrest 14. When the talker speaks, the arrays 12*a-b* may pick up the same speech signal with different time delays, loudness, and timbre based on the talker's head position. The microphone signals 18*a-b* from microphone arrays 12*a-b*, respectively, may also be contaminated with uncorrelated cabin noise. To optimally mix the signals 18*a-b* from microphone arrays 12*a-b*, a digital algorithm 20 may be implemented. The details of an example of such a software algorithm 220 is illustrated in FIG. 2.

A left front microphone 212*a* and a right front microphone 212*b* produce microphone signals 218*a-b*, respectively. A cross-correlation procedure may be carried out that estimates the time delay between the two signals 218*a-b* (block 222). This procedure can be time-optimized by a quasi-stationary assumption on the position of the talker's head 16. Assuming that the head moves slowly relative to the digital sampling rate, only a small number of possible time delays (lags) may need to be checked relative to the last time delay estimate. Additionally, because the distance between the microphone arrays is known a priori, the maximum and minimum possible lag between the two signals can be calculated.

By use of the time delay estimate, the two signals can be adaptively delayed to sync up (blocks 224*a-b*), then safely mixed together without comb filtering. However, the simple sum of the two signals is not guaranteed to have level speech amplitude. This problem may be overcome by estimating the source intensity of the talker's voice (block 226) using the estimated time delay from the previous step 222. If the voice is modelled as an omnidirectional sound source that lies on the line segment drawn between the two microphone arrays, intensity compensation is trivial. In reality, the function relating time delay to intensity is further complicated by the directionality of the voice and microphone arrays. Still, the function is guaranteed to be smoothly analytic, so it can be represented by a low-order polynomial and trained offline.

After estimating the source intensity/amplitude from the time delays (block 226), a compensation gain may be calculated based on the estimated intensity/amplitude, and the compensation gain may be applied to each time delayed channel (blocks 228*a-b*). The gain compensated and time delayed channels may then be mixed together (block 230) into a single cleaned speech signal (block 232). This signal may have a constant level and timbre regardless of the head position of the talker, and uncorrelated noise appearing on the original signals is attenuated. The signal can be routed out for the purposes of hands free telephony or in-car-communication.

Figure 3:
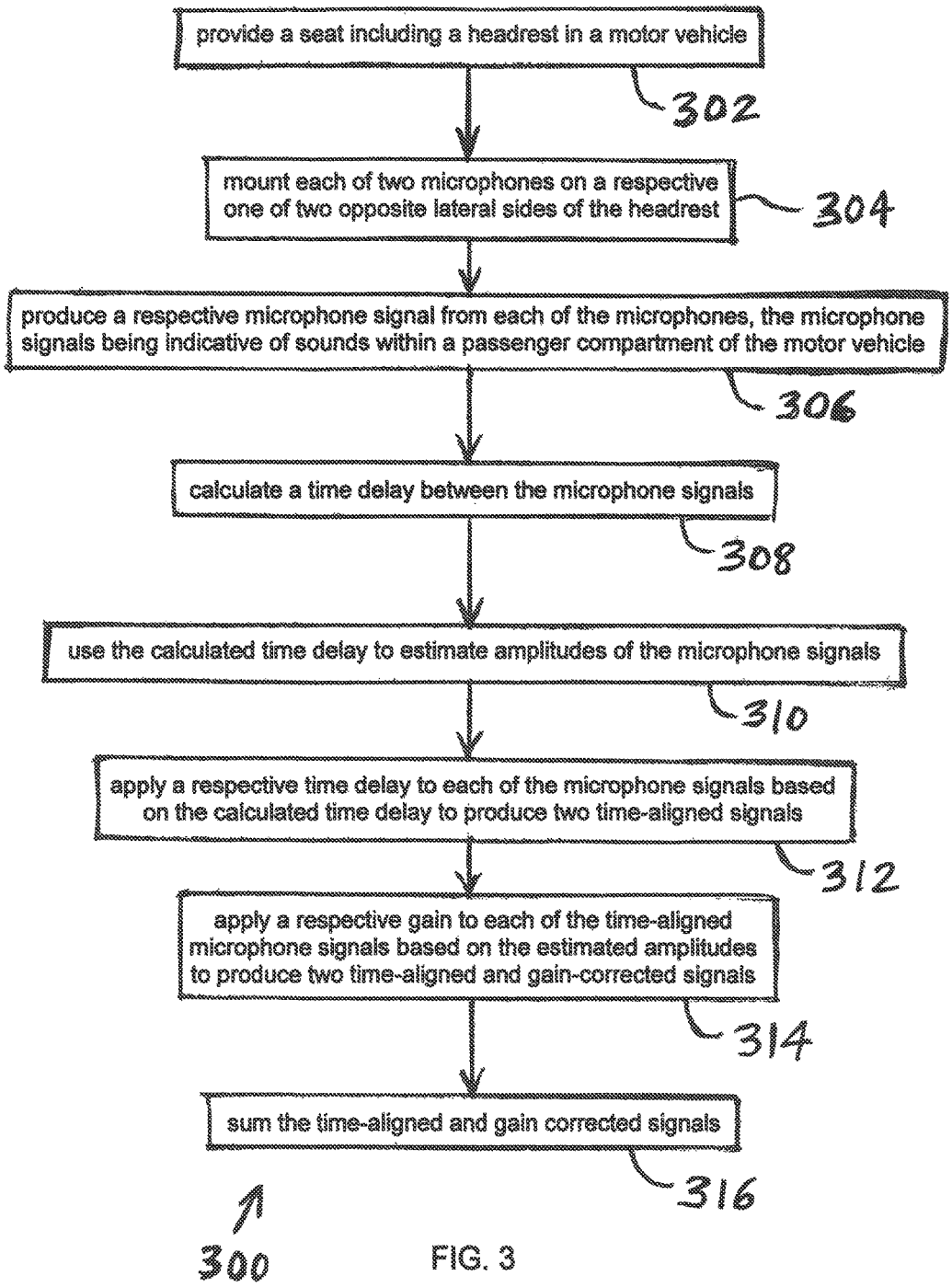
FIG. 3 is a flow chart of another example embodiment of a dual microphone near field voice enhancement method of the present invention for a motor vehicle.

FIG. 3 illustrates another example embodiment of a dual microphone near field voice enhancement method 300 of the present invention for a motor vehicle. In a first step 302, a seat including a headrest is provided in the motor vehicle. For example, a seat including extended headrest 14 may be provided in a vehicle.

Next, in step 304, each of two microphones is mounted on a respective one of two opposite lateral sides of the headrest. For example, two microphones 12*a-b* may be mounted on either side of extended headrest 14.

In a next step 306, a respective microphone signal is produced from each of the microphones. The microphone signals are indicative of sounds within a passenger compartment of the motor vehicle. For example, microphone signals 18*a-b* may be produced from microphones 12*a-b*, respectively. Microphones 12*a-b* may pick up sounds produced within the passenger compartment of the motor vehicle.

In step 308, a time delay between the microphone signals is calculated. For example, a cross-correlation procedure may be used to calculate the time delay between the two signals 218*a-b*.

Next, in step 310, the calculated time delay is used to estimate amplitudes of the microphone signals. For example, the amplitude of microphone signals 218*a-b* may be estimated from the time delays by representing the amplitude as a low-order polynomial that has been trained offline.

In a next step 312, a respective time delay is applied to each of the microphone signals based on the calculated time delay to produce two time-aligned signals. For example, by use of the time delay calculation, the two signals can be adaptively delayed in order to synchronize them.

In step 314, a respective gain is applied to each of the time-aligned microphone signals based on the estimated amplitudes to produce two time-aligned and gain corrected signals. For example, a compensation gain may be calculated based on the estimated intensity/amplitude, and the compensation gain may be applied to each time delayed channel to produce two synchronized and gain-corrected signals.

In a final step 316, the time-aligned and gain-corrected signals are summed. For example, the gain-compensated and time-delayed channels may be mixed together into a single signal.

The foregoing description may refer to "motor vehicle", "automobile", "automotive", or similar expressions. It is to be understood that these terms are not intended to limit the invention to any particular type of transportation vehicle. Rather, the invention may be applied to any type of transportation vehicle whether traveling by air, water, or ground, such as airplanes, boats, etc.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A dual microphone near field voice enhancement arrangement in a motor vehicle, the arrangement comprising:

a seat including a headrest, the headrest having two opposite lateral sides;

two microphones, each said microphone being mounted on a respective one of the two opposite lateral sides of the headrest, each said microphone being configured to produce a respective microphone signal indicative of sounds within a passenger compartment of the motor vehicle; and an electronic processor communicatively coupled to the microphones and configured to:

receive the microphone signals;

calculate a time delay between the microphone signals;

use the calculated time delay to estimate amplitudes of the microphone signals;

apply a respective time delay to each of the microphone signals based on the calculated time delay to produce two time-aligned signals;

apply a respective gain to each of the time-aligned microphone signals based on the estimated amplitudes to produce two time-aligned and gain corrected signals; and sum the time-aligned and gain corrected signals.

2. The arrangement of claim 1 further comprising a loudspeaker communicatively coupled to the electronic processor and configured to emit audible sounds based on the sum of the time-aligned and gain corrected signals.

3. The arrangement of claim 1 wherein each of the two microphones is replaced by a respective array of microphones, each said array of microphones being mounted on a respective one of the two opposite lateral sides of the headrest.

4. The arrangement of claim 1 wherein the two microphones are replaced by first order endfire beamformers.

5. The arrangement of claim 1 wherein the electronic processor is configured to perform a cross-correlation procedure to calculate the time delay between the microphone signals.

6. A dual microphone near field voice enhancement method for a motor vehicle, the method comprising:

providing a seat including a headrest in the motor vehicle, the headrest having two opposite lateral sides;

mounting each of two microphones on a respective one of the two opposite lateral sides of the headrest;

producing a respective microphone signal from each of the microphones, the microphone signals being indicative of sounds within a passenger compartment of the motor vehicle;

calculating a time delay between the microphone signals;

using the calculated time delay to estimate amplitudes of the microphone signals;

applying a respective time delay to each of the microphone signals based on the calculated time delay to produce two time-aligned signals;

applying a respective gain to each of the time-aligned microphone signals based on the estimated amplitudes to produce two time-aligned and gain corrected signals; and summing the time-aligned and gain corrected signals.

7. The method of claim 6, further comprising emitting audible sounds based on the sum of the gain corrected signals.

8. The method of claim 6 wherein each of the two microphones is replaced by a respective array of microphones, each said array of microphones being mounted on a respective one of the two opposite lateral sides of the headrest.

9. The method of claim 6 wherein the two microphones are replaced by first order endfire beamformers.

10. The method of claim 6 further comprising performing a cross-correlation procedure to calculate the time delay between the microphone signals.

11. A dual microphone near field voice enhancement arrangement in a motor vehicle, the arrangement comprising:

two microphones, a first said microphone being mounted to the left of a human driver of the motor vehicle, and a second said microphone being mounted to the right of the human driver, each said microphone being configured to produce a respective microphone signal indicative of sounds within a passenger compartment of the motor vehicle;

an electronic processor communicatively coupled to the microphones and configured to:

receive the microphone signals;

calculate a time delay between the microphone signals;

use the calculated time delay to estimate amplitudes of the microphone signals;

apply a respective time delay to each of the microphone signals based on the calculated time delay to produce two time-aligned signals;

apply a respective gain to each of the time-aligned microphone signals based on the estimated amplitudes to produce two time-aligned and gain corrected signals; and sum the time-aligned and gain corrected signals; and a loudspeaker communicatively coupled to the electronic processor and configured to emit audible sounds based on the sum of the gain corrected signals.

12. The arrangement of claim 11 wherein each of the two microphones is replaced by a respective array of microphones, each said array of microphones being mounted on a respective one of the two opposite lateral sides of the driver.

13. The arrangement of claim 11 wherein the two microphones are replaced by first order endfire beamformers.

14. The arrangement of claim 11 wherein the electronic processor is configured to perform a cross-correlation procedure to calculate the time delay between the microphone signals.

* * * * *